United States Patent [19]

Braun

[11] 4,278,294

[45] Jul. 14, 1981

[54] GUIDE-RAIL ASSEMBLY FOR LONGWALL MINING APPARATUS

[76] Inventor: Gert Braun, Hofackerstr. 12a, 4300 Essen-Heisingen, Fed. Rep. of Germany

[21] Appl. No.: 92,658

[22] Filed: Nov. 9, 1979

[30] Foreign Application Priority Data

Dec. 23, 1978 [DE] Fed. Rep. of Germany ..... 2856117

[51] Int. Cl.[3] ..... E21C 27/34

[52] U.S. Cl. ..... 299/34; 198/735; 198/864; 299/43

[58] Field of Search ..... 299/32, 34, 43; 198/735, 864

[56] References Cited

U.S. PATENT DOCUMENTS

| | | | |
|---|---|---|---|
| 3,753,596 | 8/1973 | Pentith | 299/43 |
| 3,784,258 | 1/1974 | Braun et al. | 299/34 |
| 3,986,600 | 10/1976 | Pentith | 198/735 |
| 4,186,970 | 2/1980 | Minke et al. | 299/43 |

*Primary Examiner*—Ernest R. Purser
*Attorney, Agent, or Firm*—Karl F. Ross

[57] ABSTRACT

A mining apparatus has a plurality of rail sections having longitudinally abutting rail-section ends each having a predetermined longitudinal rail-section length. These rail sections together form a longitudinally extending guide rail along which a cutter-loader is displaceable. Respective conveyor trough sections are carried on the rail sections and each have a trough-section length substantially shorter than the respective rail-section length, so that longitudinal forces are transmitted via the rail sections and not by the conveyor-trough sections. The trough sections form a longitudinally extending trough in which a chain conveyor is effective.

10 Claims, 5 Drawing Figures

GUIDE-RAIL ASSEMBLY FOR LONGWALL MINING APPARATUS

FIELD OF THE INVENTION

The present invention relates to a longwall mining apparatus. More particularly this invention concerns a guide-rail assembly for such an apparatus.

BACKGROUND OF THE INVENTION

A guide-rail assembly is known from U.S. Pat. No. 3,784,358 that comprises a succession of rail sections each formed by a relatively long central subsection and a pair of relatively short end subsections that flank the respective central subsection. Horizontal pivots extending transverse to the longitudinal extension direction of the rail formed by the rail sections interconnect each of the end subsections with the respective central subsection. Limitedly flexible rods are provided at the joints between adjacent rail sections, with each rod having one end anchored in the central subsection of one rail and an opposite end anchored in the central subsection of the two intervening end subsections of the respective rail sections. These rods permit limited flexing of the rail sections and set outer limits to the longitudinal displacement of the rail sections away from each other.

Normally each rail section carries a respective trough section of a chain conveyor. The trough sections have effective longitudinal lengths that are somewhat greater than the effective longitudinal lengths of the respective rail sections, so that the ends of these trough sections abut whereas the ends of the rail section do not.

A chain for cutter-loader, constituted either as a plow or planer, has an upper reach extending through an upper longitudinal passage formed through the rail sections, and a lower reach extending in a lower passage similarly formed through the succession of rail sections. This chain pulls the cutter-loader longitudinally along the rail. A conveyor chain has an upper reach lying in the trough formed by the trough sections and carrying a plurality of conveyor-scraper elements, and a lower reach underlying the trough. Both of these chains exert with their tensioned stretches, normally their upper stretches, considerable longitudinal forces, whereas their return stretches, which are normally their lower stretches, are somewhat loose.

These forces are normally transmitted to the abutting ends of the trough sections. As a result these trough-section ends are subjected to considerable longitudinal force, often capable of bending and deforming them at their ends. When the assembly lies on uneven ground, so that adjacent rail and trough sections are not perfectly in line with one another, the forces effective on the trough sections are considerable, and can often exceed their elastic limits so as to damage them. Similarly the forces effective on the chains can become so very great as to stretch or permanently damage them.

OBJECTS OF THE INVENTION

It is therefore an object of the present invention to provide an improved mining apparatus.

Another object is the provision of an improved guide-rail assembly for a mining apparatus of the above-described general type having a cutter-loader displaceable along the front side of the guide rail, that is that side turned toward the face, and a trough on the rear side of the guide rail.

SUMMARY OF THE INVENTION

These objects are attained according to the instant invention by forming the rail-section ends with short extensions that impart to them an effective overall longitudinal length which is somewhat longer than the respective trough-section lengths. Thus with the system according to the instant invention longitudinal forces are transmitted by the massive rail sections, which are normally formed as heavy-duty steel profiles that are capable of withstanding enormous longitudinal forces without deformation. The angular gap formed between adjacent trough sections whose material is conveyed along them normally does not exceed the amount of play between them so that length changes of the conveyor trough and of the conveyor chain in them are eliminated. As a result the conveyor chain in operation is not stressed by the bending of the trough sections and is therefore not likely to be deformed longitudinally itself. Furthermore the simple conveying operation can be effected with substantially less energy than hitherto. The ends of the rail sections are easily able to absorb these various forces without deformation, these forces being greatly reduced when transmitted to the central subsections as a result of halving of the angle.

According to the invention with horizontal deflection of the rail sections the angle formed in the region of the cutter-loader change is much smaller than the horizontal deflection of the trough sections in the region of the conveyor chain. The same can be said for the angular spacing. As a result a length variation of the rail can be compensated for more easily by the cutter-loader chain than a length change of the trough can be compensated for by the conveyor chain. In fact in the rail the deflection of the rail section as a result of conveyor action can take place almost exclusively in the region of the cutter-loader chain, so that the cutter-loader chain is not subjected to any additional loading.

SPECIFIC DESCRIPTION OF THE DRAWING

Figure 1:
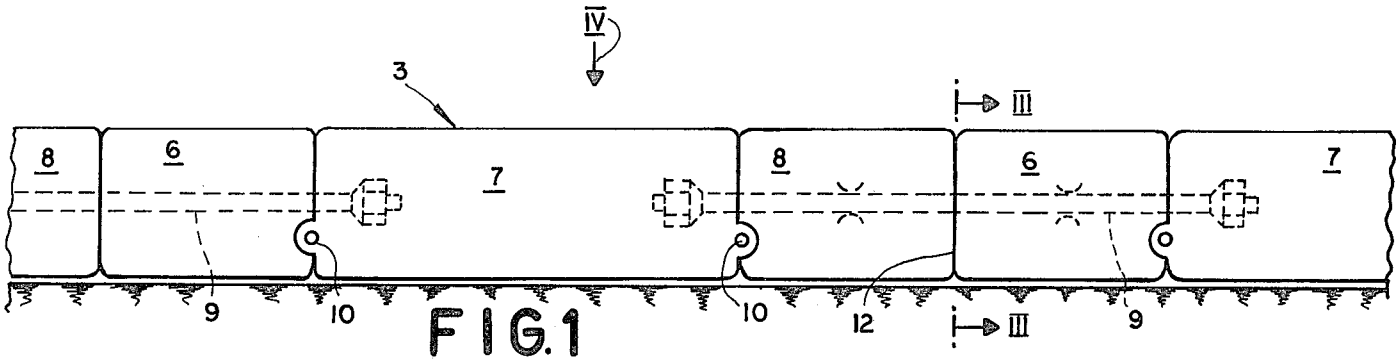
FIG. 1 is a side partly schematic view of the rail assembly according to this invention.
Figure 4:
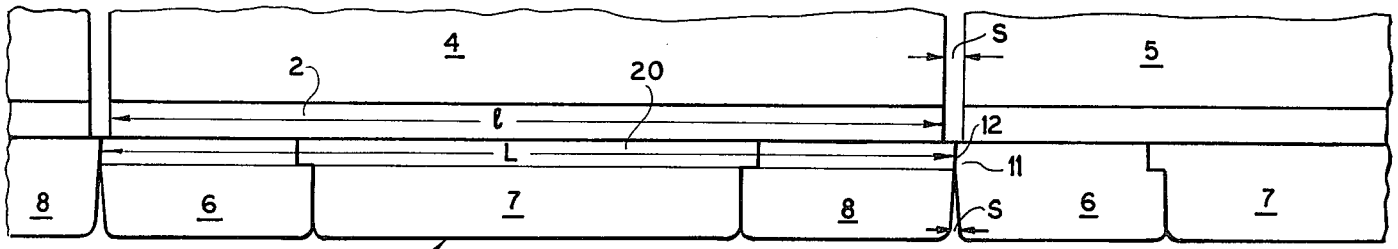
FIG. 4 is a top view taken in the direction of arrow IV of FIG. 1.
Figure 2:
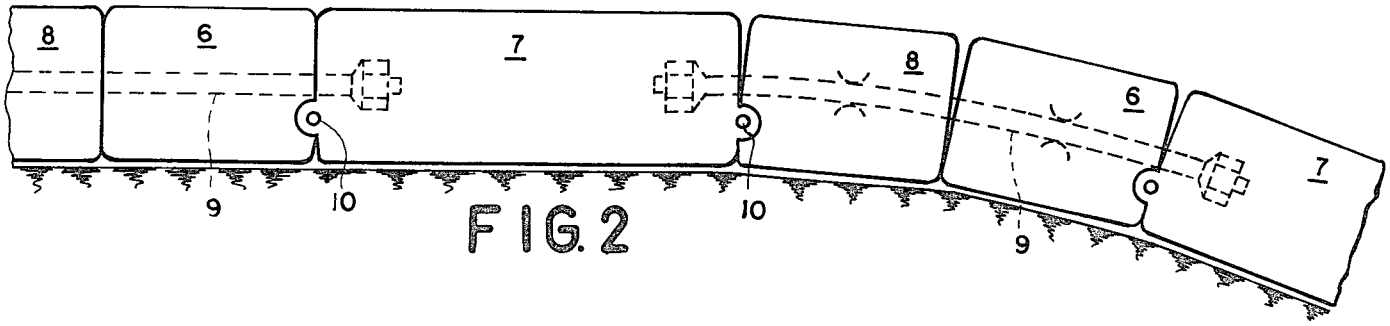
FIG. 2 is a view similar to FIG. 1 showing a rail assembly on uneven ground.

As seen in the drawing a cutter-loader, here a coal plow or planar 1 is displaceable adjacent a longitudinally extending conveyor trough 2 on a guide rail constituted by a succession of guide-rail sections 3. The trough 2 is formed by a succession of trough sections 4 and 5, and each rail section is formed by three rail subsections 6, 7, and 8 connected together by a rod 9 and pivot 10 in a manner described in the above-cited U.S. Pat. No. 3,784,258 issued 8 January 1974 to G. BRAUN and E. BRAUN.

According to the instant invention the rail sections 3 have substantially planar end faces 12 formed at their rear edges with extensions 11, and converging forwardly away from each other so that at their forward edges they are separated by a spacing s. The trough sections 4 and 5 have overall lengths l which are somewhat shorter than the lengths L of the rail sections 3, so that they are separated longitudinally by spacings S equal to approximately twice the spacings s.

Figure 3:
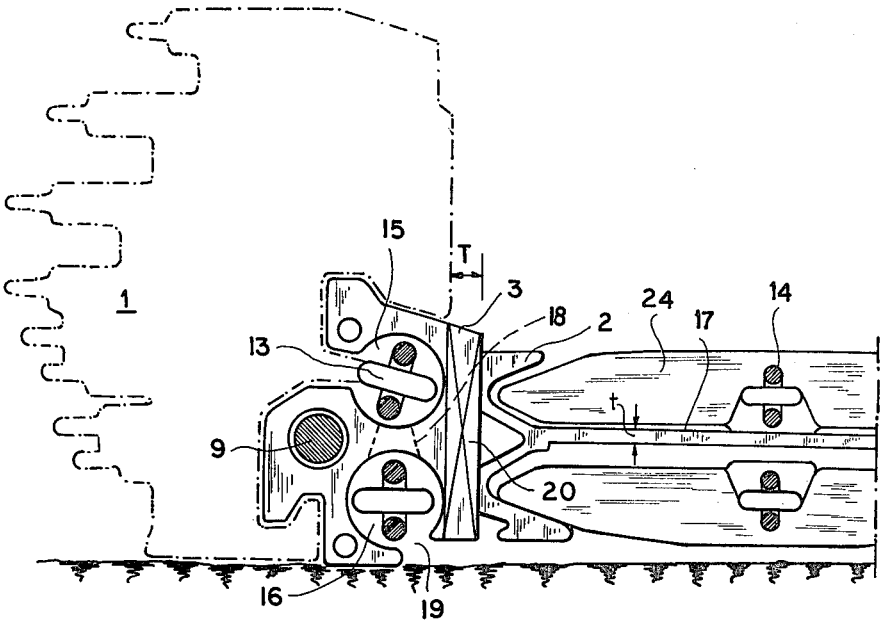
FIG. 3 is a section taken along line III—III of FIG. 1.
Figure 5:
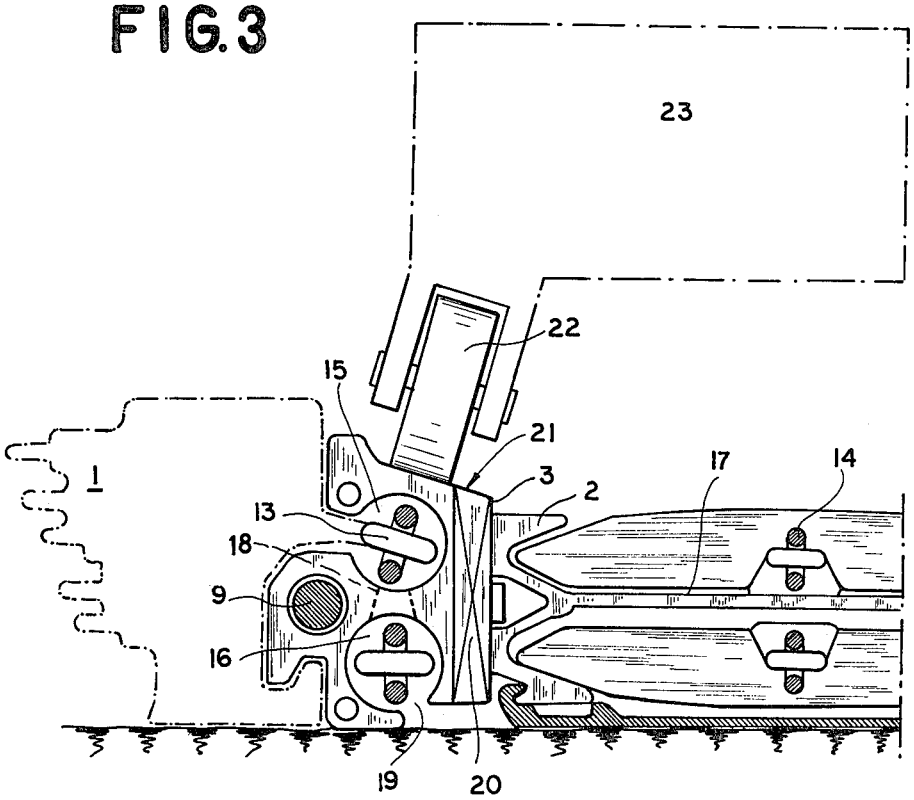
FIG. 5 is a view similar to FIG. 3 showing further aspects of the arrangement according to this invention.

As best seen in FIGS. 3 and 5 the rail sections 3 are each formed with an upper passage 15 and a lower passage 16, vertically equispaced on either side of the connecting rods 9. A cutter-loader chain 13 connected to the cutter-loader 1 has an upper stretch in the upper passage 15 and a lower stretch in the lower passage 16.

Similarly a conveyor chain 14 that carries conveyor elements 24 has an upper stretch lying above the floor 17 of the trough 2 and a lower stretch lying below this floor 17. The floor 17 is approximately level with the rods 9 and, therefore, is horizontally equispaced between the upper and lower stretches of the chain 13 in the passages 15 and 16.

The short end subsections 6 and 8 and the long central subsections 7 are formed with throughgoing vertical holes 18 bridging the passages 15 and 16 and allowing fines to work their way down into the lower passage 16, whence they can exit via a slot 19 at the bottom of the passage 16.

In addition the rear faces 20 of the rail sections 3 are of an increased thickness T which is equal to approximately twice the thickness t of the walls of the trough 2. Thus these regions can withstand enormous longitudinal forces without damage or deformation. In addition this face 20 forms a smooth upper surface 21 on which a roller 22 of a mining machine 23 of the portal type may roll.

With the system according to the instant invention, therefore, the longitudinal forces effective on the assembly are all transmitted longitudinally by the thickened rear edge 20 of the guide-rail sections 3. The trough sections 4 and 5 do not transmit any comparable longitudinal forces, so that these substantially lighter parts are not unduly loaded.

I claim:

1. A mining apparatus comprising:

A plurality of rail sections having longitudinally abutting rail-section ends and each having a predetermined longitudinal rail-section length, said rail sections together forming a longitudinally force-transmitting and extending guide rail having a longitudinally extending passage;

a longitudinally extending chain in said passage;

a cutter-loader displaceable along said guide rail and secured to said chain;

respective conveyor trough sections carried on said rail sections and each having a trough-section length substantially shorter than the respective rail-section length, said trough sections being longitudinally spaced by predetermined spacings so as to be out of longitudinal force-transmitting engagement with one another and together forming a longitudinally extending trough, whereby substantially all longitudinal forces are transmitted by said rail and chain; and a chain conveyor extending longitudinally along said trough.

2. The apparatus defined in claim 1 wherein each of said sections includes a pair of relatively short end sections and a central subsection flanked by and articulated with the respective end subsections, and rods interconnecting the end subsections of adjacent rail sections.

3. The apparatus defined in claim 1 wherein said rail is formed with two such passages vertically spaced apart, said chain having a respective stretch in each passage.

4. The apparatus defined in claim 3 wherein said trough has a floor substantially level with said rail between said passages.

5. The apparatus defined in claim 1 wherein said rail-section ends are substantially planar and have abutting upright rear edges adjacent said trough and spaced upright front edges remote from said trough.

6. The apparatus defined in claim 5 wherein said front edges are spaced longitudinally apart by a distance equal generally to half of said spacing.

7. The apparatus defined in claim 5 wherein said rail sections have thickened rear faces terminating at said rear edges and of a thickness equal to generally twice the wall thickness of said trough sections.

8. The apparatus defined in claim 8 wherein said thickened rear faces have upper edges forming a continuous rolling surface, whereby a mining machine can roll on said continuous surface.

9. A mining apparatus comprising:

a plurality of rail sections having longitudinally abutting rail-section ends and each having a predetermined rail-section length, said rail sections together forming a longitudinally force-transmitting and extending guide rail having a longitudinally extending passage, each rail section including a relatively long central subsection and a pair of end subsections flanking and articulated about respective horizontal axes with the respective central subsection;

a longitudinally extending chain in said passage;

a cutter loader dispaceable along said guide rail;

respective upwardly open conveyor trough sections carried on said rail sections and each having a trough-section length substantially shorter than the respective rail-section length, said trough sections being longitudinally spaced by predetermined spacings so as to be out of longitudinal force-transmitting engagement with one another and together forming a longitudinally extending trough, whereby substantially all longitudinal forces are transmitted by said rail and chain; and a chain conveyor extending longitudinally along said trough.

10. An apparatus for guiding a coal plow on the conveyor trough of a scraper-type chain conveyor, in particular a one-chain scraper-type conveyor, with a plow guide rail secured to the conveyor trough and formed of a succession of rail sections articulated together, the plow guide rail being subdivided adjacent each trough section into three rail sections of which the end sections abut one another and are connected together by an elastically bendable rod and are articulated on the respective middle sections for pivoting through a predetermined distance about pivots orthogonal to the respective conveyor section, characterized in that the outer ends of the end segments (6, 8) have projections (11) extending beyond the trough sections so as to produce in a manner known per se spacings (S) between the adjacent trough-section ends and that these extensions (11) directly engage one another at these end faces (12) and thereby force transmission takes place through the rail sections (6, 7, 8).

* * * * *